United States Patent [19]

Herold et al.

[11] Patent Number: 4,688,484

[45] Date of Patent: Aug. 25, 1987

[54] MECHANISM FOR THE PARALLEL CLAMPING OF PRINTING PLATES ON THE PLATE CYLINDER OF PRINTING MACHINES

[75] Inventors: Manfred Herold, Kahl; Herbert Rebel, Rodgau, both of Fed. Rep. of Germany

[73] Assignee: M.A.N. Roland Druckmashchinen Aktiengesellschaft, Fed. Rep. of Germany

[21] Appl. No.: 859,043

[22] Filed: May 2, 1986

[30] Foreign Application Priority Data

May 9, 1985 [DE] Fed. Rep. of Germany ..... 3516682

[51] Int. Cl.[4] ..... B41F 1/28

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 3,658,002 | 4/1972 | Preuss | 101/415.1 |
| 3,752,075 | 8/1973 | Fusco | 101/415.1 |
| 3,903,796 | 9/1975 | Jeschke et al. | 101/415.1 |
| 3,908,546 | 9/1975 | Porter | 101/415.1 |
| 3,913,480 | 10/1975 | Dauner et al. | 101/415.1 |
| 4,010,685 | 3/1977 | Trageser | 101/415.1 |
| 4,546,702 | 10/1985 | Dorow | 101/415.1 |
| 4,596,188 | 6/1986 | Bonomi | 101/415.1 |
| 4,598,642 | 7/1986 | Sauer et al. | 101/415.1 |

*Primary Examiner*—E. H. Eickholt

*Attorney, Agent, or Firm*—Leydig, Voit & Mayer

[57] ABSTRACT

A quick-action plate clamping mechanism for a plate cylinder of a printing press consists of a pressure strip disposed axially in a recess along the gap in the plate cylinder wherein the recess extends behind the plane of the rear gap wall and parallel thereto, the pressure strip being displaceable in the gap by means of an eccentric bolt which is disposed outside the cylinder center plane parallel to the clamp screws in the rear clamping bar and with specially formed recesses in the pressure strip and corresponding projections on a co-acting member being provided which are respectively situated opposite the clamp screws and supported by compression springs thereby enabling a uniform parallel clamping movement to be carried out in the direction of the rear clamping bar.

6 Claims, 5 Drawing Figures

MECHANISM FOR THE PARALLEL CLAMPING OF PRINTING PLATES ON THE PLATE CYLINDER OF PRINTING MACHINES

FIELD OF THE INVENTION

The present invention relates generally to a mechanism for the parallel clamping of printing plates on the plate cylinder of a printing press and more particularly concerns a quick-action clamping mechanism therefor.

BACKGROUND OF THE INVENTION

One form of clamping mechanism for the plate cylinder of a printing press is shown in German Pat. No. 2,200,187. However, a disadvantage of this mechanism is that the rear clamping rail is disposed, without any lateral alignment means in the cylinder gap, on an angle bar displaceable circumferentially in the gap, and an increased clamping travel is required to clamp it from its unclamped position, in which it is pushed against its gap wall, by means of a quick-action clamping mechanism with a lever transmission system. The clamping movement in this arrangement is in the circumferential direction of the cylinder. When the printing plate is in the released condition, this bar can be displaced in the direction of the gap wall facing the rear clamping bar and be disengaged from the gap wall by an eccentric through a lever transmission system. Since the rear clamping bar is disposed between two compression springs, any inequality in the disengaged positions of the axially distributed clamp screws (of which there are at least two) affects the parallelism of the displacement of the rear clamping bar in relation to the gap wall when the plate is clamped by means of the quick-action clamping mechanism.

If during the preparatory work for clamping a new printing plate, the clamp screws in the rear clamping bar are not released by exactly the same amounts, then during the quick-action clamping operation, the rear clamping bar, which is not guided accurately laterally, tilts, and the rear printing plate end is skewed, and in the case of a sensitive printing plate this means that the plate is elongated on one side and distorted. It is then impossible to clamp the plate in exact registration, since the plate deformation cannot be cancelled out even by a subsequent correction using the clamp screws. Nor is it possible to obtain a defined clamping force over the printing plate width if the two clamping bars are not in a parallel position, because of the above-mentioned arrangement of two counter-acting compression springs, i.e. one between the clamping bars and one between the eccentric and a rocking lever. Automatic re-clamping by way of the compression spring between the clamping bars is possible theoretically, but in practice the required clamping force cannot be so applied, particularly in the case of large printing plate formats. Another disadvantage is that the rocking lever mounting must be very stable, with the result that it requires a considerable amount of space.

In contrast to the above, the quick-action clamping mechanism disclosed in German Pat. No. 2,754,080 does not include a series arrangement of a quick-action clamping mechanism for pre-clamping and a clamping mechanism for final clamping. Although tilting of the rear clamping bar can be avoided in this way, because the quick-action clamping of the printing plate is carried out with an accurately defined force by means of a single operation through parallel guidance of the rear clamping bar in the cylinder gap by means of a symmetrical scissors lever linkage, this mechanism, as shown in FIG. 1 of the patent, does not permit lateral alignment or alignment in sections circumferentially with respect to the cylinder. Therefore, it is not possible to correct prints which have changed due to stresses in hygroscopic printing material or in the elastic rubber blankets, nor is it possible to adjust individual printing plates to one another in the case of multi-color machines. It is precisely these corrections, of course, which are fundamental importance. In addition, the quick-action and final clamping functions cannot be separated in order to avoid any undesirable effects.

German Pat. No. 3,127,586 discloses a quick-action clamping mechanism for parallel clamping, in which an angle bar for clamping printing plates of different print lengths is disposed to be adjustable and lockable in a number of fixed positions parallel to the print end, but in which only a limited clamping force can be produced during quick-action clamping by a leaf spring acting on the angle bar. The mechanism shown in FIG. 2 of this patent can be provided with a divided clamping bar but section-wise correction of the print is essentially not possible because a divided rear clamping bar is again coupled by way of the quick-acting clamping mechanism disposed symmetrically in the cylinder center plane. Thus the quick-action clamping and final clamping functions are not capable of separation, so that undesirable effects on the clamping force are inevitable.

OBJECTS AND SUMMARY OF THE INVENTION

The primary object of the invention, therefore, is to provide a mechanism wherein a rear continuous or divided clamping bar may be guided do uniformly parallel to its gap wall with defined clamping forces during quick-action clamping, without the mechanism impairing its function and form for final clamping, while enabling the quick-action clamping mechanism to be disposed in the plate cylinder so as to require the minimum amount of space.

This problem is solved according to the present invention by a quick-action plate clamping mechanism for a plate cylinder of a printing press which consists of a pressure strip disposed axially in a recess along the gap in the plate cylinder wherein the recess extends behind the plane of the rear gap wall and parallel thereto, the pressure strip being displaceable in the gap by means of an eccentric bolt which is disposed outside the cylinder center plane parallel to the clamp screws in the rear clamping bar and with specially formed recesses in the pressure strip and corresponding projections on a co-acting member being provided which are respectively situated opposite the clamp screws and supported by compression springs thereby enabling a uniform parallel clamping movement to be carried out in the direction of the rear clamping bar.

The advantage of the mechanism is that during quick-action clamping, in conjunction with a rear divided clamping bar, the printing plate is clamped in parallel to achieve registration accuracy, and at the same time during final clamping the known correction facilities for the print by means of a divided clamping bar and associated clamp screws are maintained. The space-saving arrangement of the quick-action clamping mechanism with a quick-action clamping eccentric also results in a minimum gap angle and hence maximum cylinder circumference for clamping the printing plate.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
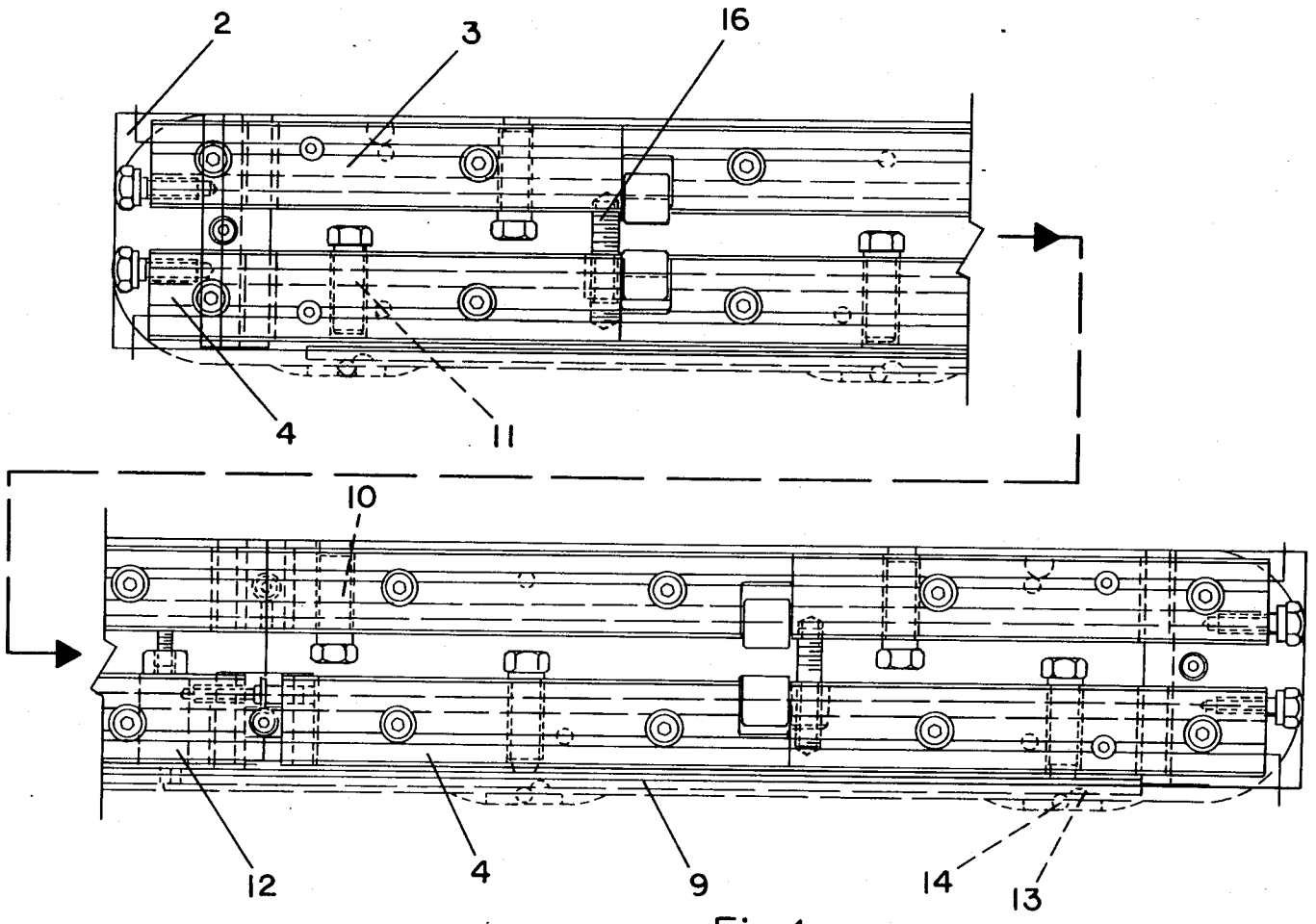
FIG. 1 is a plan view of the plate cylinder surface having the gap for the plate clamping bars.
Figure 2:
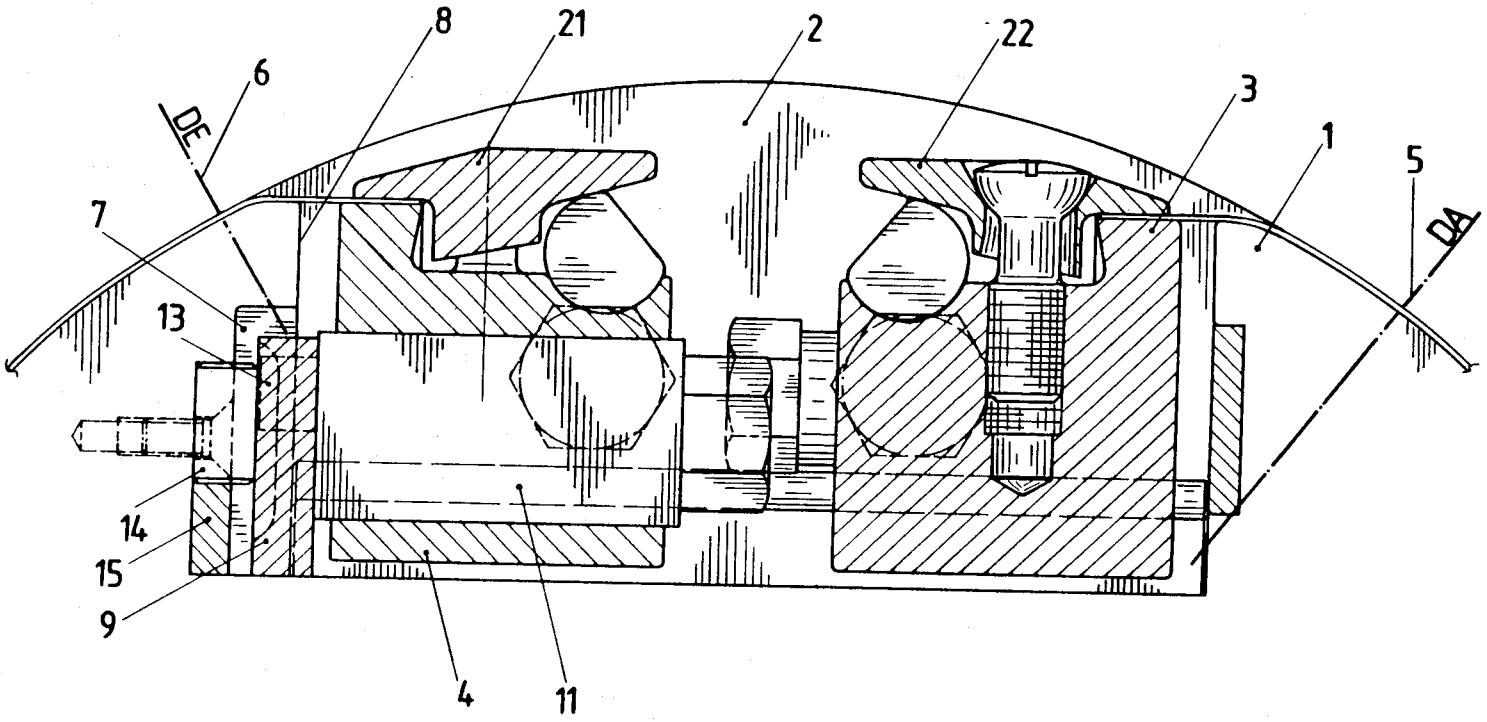
FIG. 2 is a partial cross sectional view, on an enlarged scale, of a plate clamping mechanism of the present invention disposed in the plate cylinder gap.

Referring now to FIGS. 1 and 2 of the drawings, the plate cylinder 1 of a printing press is formed with an axially extending gap 2 within which means for clamping printing plates are disposed. The plate clamping means are in the form of a front clamping bar 3 divided over the length of the plate cylinder 1 and a correspondingly divided rear clamping bar 4 and are disposed respectively at the print start 5 (also designated DA) and print end 6 (also designated DE) of the gap 2. The divided clamping bars 3, 4 are disposed in the gap 2 in known manner and are actuated by respective clamp screws 10, 11. The front edge of the printing plate and the rear edge of the printing plate are also clamped in the bars 3, 4 in known manner by end clamping means 21, 22 (see FIG. 2).

Pursuant to the present invention, the quick-action clamping system consists of a pressure strip 9 disposed axially along the gap 2 in a recess 7 in the plate cylinder 1. The recess 7 extends behind the rear gap wall 8 and parallel thereto. The pressure strip 9 is displaceable along the gap 2 by means of an eccentric bolt 12 disposed outside the cylinder center plane parallel to the clamp screws 11 in the rear divided clamping bar 4.

In further accordance with the invention, specially devised recesses 13 are formed in the pressure strip 9 and corresponding projections are carried on a co-acting member, also disposed in the gap recess 7. Both the special recesses 13 and the cooperating member 15 are situated opposite the clamp bolts 11 and against the bias imposed by compression spring means 16, the pressure strip 9 can perform a parallel movement in the direction of the rear clamping bar 4.

Figure 3:
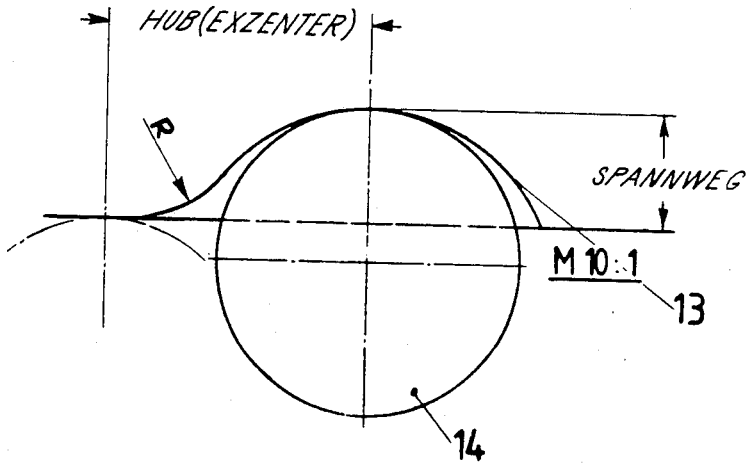
FIG. 3 is a somewhat schematic detail of the plate clamping mechanism on a highly enlarged scale.

Preferably, the projections are in the form of pressure rollers 14 carried on the co-acting member 15 and the recesses 13 in the pressure strip 9 are of a generally concave form with a pitch which, as shown in FIG. 3, is greater at the start of the clamping movement and then smaller, terminating in a radius R defining an arc tangent to the face of the pressure strip 9. The divided clamping bars 3, 4 also are axially slidable in the gap 2.

Figure 4:
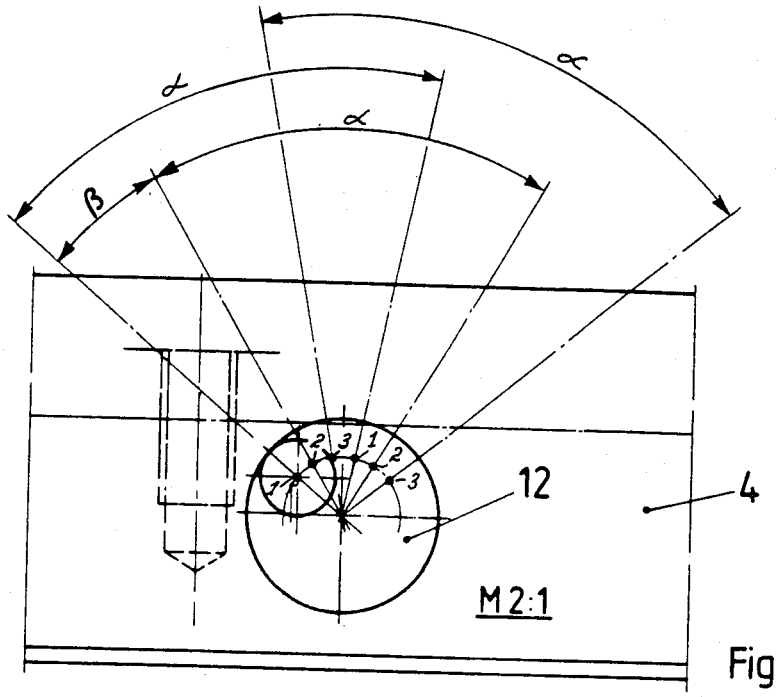
FIG. 4 shows the angle of adjustment of the eccentric bolt in two positions of the axial adjustment on an enlarged scale; and, FIG. 5 illustrates another embodiment of the invention.

FIG. 4 shows the angle $\alpha$ of adjustment of the eccentric bolt 12 in a first position, and in broken lines in a second position, since the eccentric bolt 12 performs a compensatory movement about the angle $\beta$ with the axial adjustment while the pressure strip 9 remains in its position. It will be understood, of course, that given appropriate design, the pressure strip 9 can also perform the compensatory movement. The divided clamping bars 3, 4 are also guided to be displaceable in known manner in sections peripherally and parallel or at an angle to the cylinder axis, and also jointly. Thus the system according to the invention permits a uniform parallel movement in the direction of the rear divided clamping bar 4 in the case of a quick-action clamping, without the quick-action clamping mechanism restricting the known correction facilities circumferentially and/or axially of the cylinder. This results in the above-described advantages in conjunction with a space-saving arrangement of a quick-action clamping mechanism with eccentric adjustment for the plate cylinder of a printing press.

Figure 5:
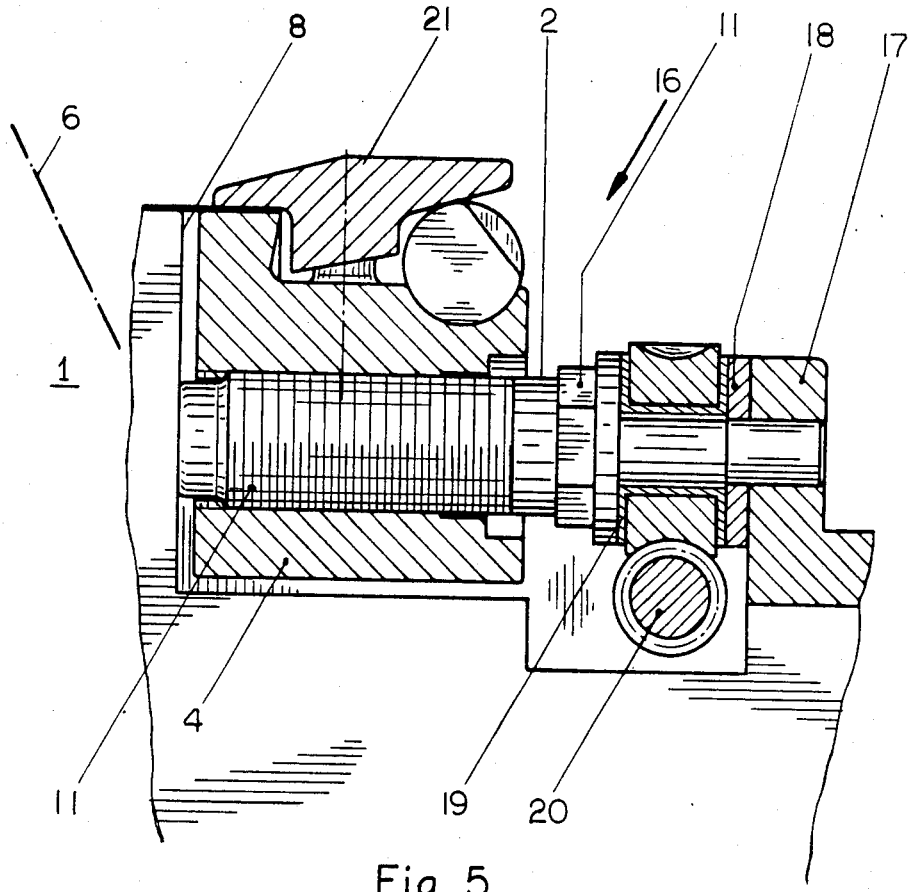

FIG. 5 shows another embodiment of the invention in which a somewhat wider cylinder gap is required. To simplify matters, like references have been used for both embodiments. The quick-action clamping mechanism shown in FIG. 5 consists of a common drive unit 16 mounted in a supporting wall 17 which is fixed to the cylinder and is disposed between the front and rear clamping bars 3, 4. Operation of a central adjustment 20, preferably a screw, chain or gearwheel transmission, enables the individual clamp screws 11 to be driven by friction elements 18 by way of friction surfaces 19, the rear clamping bar 4 being adapted to be clamped in parallel relationship. According to a further alternative, the central adjustment 20 can also be selectively disengageable or similarly separable so that no frictional connection is necessary, if desired. The conventional clamping mechanism described above for final clamping remains unchanged in form and function in this embodiment, so that the clamping correction facilities cannot be restricted by the quick-action clamping mechanism.

We claim as our invention:

1. A mechanism for parallel clamping of printing plates on the plate cylinder of a printing press having a front clamping bar and a rear clamping bar in the plate cylinder gap, on which bars the printing plate ends can be clamped and which are movable substantially in the direction of the plate cylinder circumference by means of axially spaced clamp screws, the clamp screws of the front clamping bar bearing directly against the facing gap wall and the rear clamping bar being engageable by a quick-action clamping mechanism from an unclamped position in which it is pushed against the rear gap wall, the mechanism including a quick-action clamping eccentric for pre-clamping and clamp screws for final clamping with compression springs provided between the front and rear clamping bars for automatically returning the clamping bars to their starting positions and wherein the quick-action clamping mechanism comprises, in combination, a pressure strip disposed axially in a recess along the gap in the plate cylinder, said recess extending behind the plane of the rear gap wall and parallel thereto, said pressure strip being displaceable in the gap recess by means of an eccentric bolt which is disposed outside the cylinder center plane parallel to the clamp screws in the rear clamping bar with specially formed recesses in said pressure strip and corresponding projections on a co-acting member disposed respectively opposite the rear clamp screws and supported by compression spring means thereby enabling a uniform parallel clamping movement to be carried out in the direction of the rear clamping bar.

2. A quick-action clamping mechanism according to claim 1, wherein said projections are in the form of pressure rollers.

3. A quick-action clamping mechanism according to claim 2 wherein said recesses in said pressure strip are constructed with a pitch which is larger at the start of the clamping travel and then smaller, terminating in a radius R defining an arc tangent to the face of said pressure strip.

4. A quick-action clamping mechanism according to claim 1 wherein the clamping bars are guided to be axially slidable in the gap, said eccentric bolt being adapted to generate a relative axial displacement between said pressure strip and the clamping bars and the clamping bars also being guided to be displaceable in sections or jointly in a substantially circumferential direction with respect to the cylinder.

5. A mechanism for parallel clamping of printing plates on the plate cylinder of a printing press having a front clamping bar and a rear clamping bar in the plate cylinder gap, on which bars the printing plate ends can be clamped and which are movable substantially in the direction of the plate cylinder circumference by means of axially spaced clamp screws, the clamp screws of the front clamping bar bearing directly against the facing gap wall and the rear clamping bar being engageable by a quick-action clamping mechanism from an unclamped position in which it is pushed against the rear gap wall, the mechanism including a quick-action clamping eccentric for pre-clamping and clamp screws for final clamping with compression springs provided between the front and rear clamping bars for automatically returning the clamping bars to their starting positions and wherein the quick-action clamping mechanism includes a common drive unit such as a screw, chain, gear transmission or the like, which is mounted in a support wall fixed to the cylinder and disposed between the front and rear clamping bars and the individual clamp screws are drivable, by means of friction elements and friction surfaces upon actuation of a central adjustment facility, the rear clamping bar being clampable in parallel relationship thereto.

6. A quick-action clamping mechanism according to claim 5, wherein the individual clamp screws are directly drivable by actuation of said central adjustment facility and which are arranged to be selectively disengageable therefrom.

* * * * *